US005898971A

United States Patent [19]

Contant

[11] Patent Number: 5,898,971

[45] Date of Patent: May 4, 1999

[54] VACUUM CLEANER HOUSING WITH A MINIMIZED NUMBER OF UNMOULDING DIRECTIONS

[75] Inventor: Cornelis J. Contant, Hoogeveen, Netherlands

[73] Assignee: U.S. Philips Corporation, New York, N.Y.

[21] Appl. No.: 08/882,871

[22] Filed: Jun. 26, 1997

[30] Foreign Application Priority Data

Jun. 28, 1996 [EP] European Pat. Off. ..... 96201803

[51] Int. Cl.[6] ..... A47L 9/22

[52] U.S. Cl. ..... 15/327.2; 15/412

[58] Field of Search ..... 15/327.1, 327.2, 15/327.7, 412

[56] References Cited

U.S. PATENT DOCUMENTS

| | | | |
|---|---|---|---|
| 3,381,329 | 5/1968 | Wied | 15/327.2 |
| 3,636,681 | 1/1972 | Batson et al. | 15/327.2 |
| 3,781,460 | 12/1973 | Westergren et al. | 15/327.2 |
| 4,656,688 | 4/1987 | Jacob et al. | 15/327.2 |
| 5,560,075 | 10/1996 | Jankowski | 15/327.2 |

*Primary Examiner*—Terrence R. Till

*Attorney, Agent, or Firm*—Ernestine C. Bartlett; Norman N. Spain

[57] ABSTRACT

A vacuum cleaner has a housing (1) in which a dust chamber (17) and a motor chamber (13) are accommodated. The motor chamber (13) is connected to the dust chamber (17) via a motor inlet (15). The housing (1) includes a lower housing part (37) and an upper housing part (39). The dust chamber (17) is present at a side (43) of the upper housing part (39) which faces away from the lower housing part (37), and is bounded by a depression (41) in the upper housing part (39) which faces the lower housing part (37). The motor chamber (13) includes a chamber (45) of the upper housing part (39) which is present at a side (49) of the upper housing part (39) which faces the lower housing part (37). The depression (41) defines an unmolding direction (X) of the upper housing part (39). The chamber (45) has an unmolding direction (X') which is parallel to the unmolding direction (X) of the upper housing part (39), while the motor inlet (15) is provided in the upper housing part (39) and extends in a plane which intersects the unmolding direction (X). The upper housing part (39) and the lower housing part (37) can be manufactured by means of an injection molding process with a minimum number of auxiliary mold pieces or inserts, the lower housing part (37) being of a very simple construction.

6 Claims, 5 Drawing Sheets

VACUUM CLEANER HOUSING WITH A MINIMIZED NUMBER OF UNMOULDING DIRECTIONS

BACKGROUND OF THE INVENTION

The invention relates to a vacuum cleaner with a housing which is provided with a dust chamber and a motor chamber in which a suction unit is present, said dust chamber being connected to said motor chamber via a motor inlet, while the housing comprises a lower housing part and an upper housing part.

The invention also relates to a housing suitable for use in a vacuum cleaner according to the invention.

The invention also relates to an upper housing part suitable for use in a vacuum cleaner according to the invention.

A vacuum cleaner of the kind mentioned in the opening paragraph is generally known and widely used. The lower housing part and the upper housing part of the housing of such a vacuum cleaner are manufactured by means of an injection molding process. The dust chamber, the motor chamber, and the motor inlet are formed in the lower housing part and the upper housing part during the injection molding process through the use of a mold suitable for this purpose.

It is a disadvantage of the known vacuum cleaner that a number of auxiliary mold parts such as, for example, so-called mold inserts must be used in addition to the mold itself in said injection molding process. Predetermined spaces in the mold such as, for example, a space in the mold corresponding to the motor inlet are kept free from synthetic resin by means of such mold inserts during the injection molding process, so that said spaces are formed in the housing. Such auxiliary mold pieces must be provided in the mold in an accurate manner and should be removed from the molded housing after the injection molding process has been completed.

OBJECTS AND SUMMARY OF THE INVENTION

It is an object of the invention to provide a vacuum cleaner of the kind mentioned in the opening paragraph whose upper housing part and lower housing part constituting the housing can be manufactured in an injection molding process with molds which are as simple as possible and which comprise the smallest possible number of auxiliary mold pieces.

The invention is for this purpose characterized in that the dust chamber is present at a side of the upper housing part facing away from the lower housing part and is bounded by a depression of the upper housing part which faces towards the lower housing part and which defines an unmoulding direction of the upper housing part, while the motor chamber comprises a chamber of the upper housing part which is present at a side of the upper housing part facing towards the lower housing part and has an unmoulding direction which is parallel to the unmoulding direction of the upper housing part, the motor inlet being provided in the upper housing part and extending in a plane which intersects the unmoulding direction. The unmoulding direction of the upper housing part is a direction which is defined with respect to the upper housing part and in which the upper housing part can be removed from the mold after the injection molding process. Since the unmoulding direction of the chamber of the upper housing part belonging to the motor chamber and the unmoulding direction of the depression of the upper housing part bounding the dust chamber are mutually parallel, the motor chamber and the dust chamber can be kept free from synthetic resin in the injection molding process by means of mold parts which are integral with the mold of the upper housing part. The motor inlet can also be kept free from synthetic resin in the injection molding process by means of a further mold part which is integral with the mold of the upper housing part because the motor inlet is provided in the upper housing part and extends in a plane which intersects said unmoulding direction. The dust chamber, the motor chamber, and the motor inlet are thus formed in the upper housing part without the use of auxiliary mold pieces. Since the dust chamber and the motor inlet are formed in the upper housing part, the lower housing part can be manufactured by means of a comparatively simple mold.

A special embodiment of a vacuum cleaner according to the invention is characterized in that the motor inlet is present at a side of the suction unit which faces away from the lower housing part. The fact that the motor inlet is provided in the upper housing part at a side of the suction unit facing away from the lower housing part further simplifies the upper housing part, so that also the mold for the upper housing part is further simplified.

A further embodiment of a vacuum cleaner according to the invention is characterized in that the motor inlet extends substantially perpendicularly to the unmoulding direction. Since the motor inlet in the upper housing part extends substantially perpendicularly to the unmoulding direction, the upper housing part can be removed from the mold in the unmoulding direction in a simple manner after the injection molding process.

A yet further embodiment of a vacuum cleaner according to the invention is characterized in that the dust chamber is closable by means of a lid which extends over the depression and over the motor inlet. The motor inlet in this embodiment is present next to said depression, an air channel from the dust chamber to the motor chamber being bounded by said lid and the motor inlet. The fact that said air channel is bounded by the motor inlet and the lid which does not form part of the upper housing part implies that also the air channel can be provided in the upper housing part without further auxiliary mold pieces by means of the injection molding process.

A special embodiment of a vacuum cleaner according to the invention is characterized in that a motor filter is placeable at a side of the motor inlet which faces away from the lower housing part. The placement of the motor filter at a side of the motor inlet facing away from the lower housing part affords a user of the vacuum cleaner a simple access to the motor filter via the lid of the dust chamber for cleaning or replacement purposes.

A further embodiment of a vacuum cleaner according to the invention is characterized in that the suction unit comprises a motor shaft which is directed substantially parallel to the unmoulding direction. The suction unit in this embodiment is placed immediately next to and parallel to the dust chamber, whereby a compact construction of the vacuum cleaner housing is provided.

BRIEF DESCRIPTION OF THE DRAWINGS

The invention will be explained in more detail below with reference to the drawing, in which.

DESCRIPTION OF THE PREFERRED EMBODIMENTS

Figure 1:
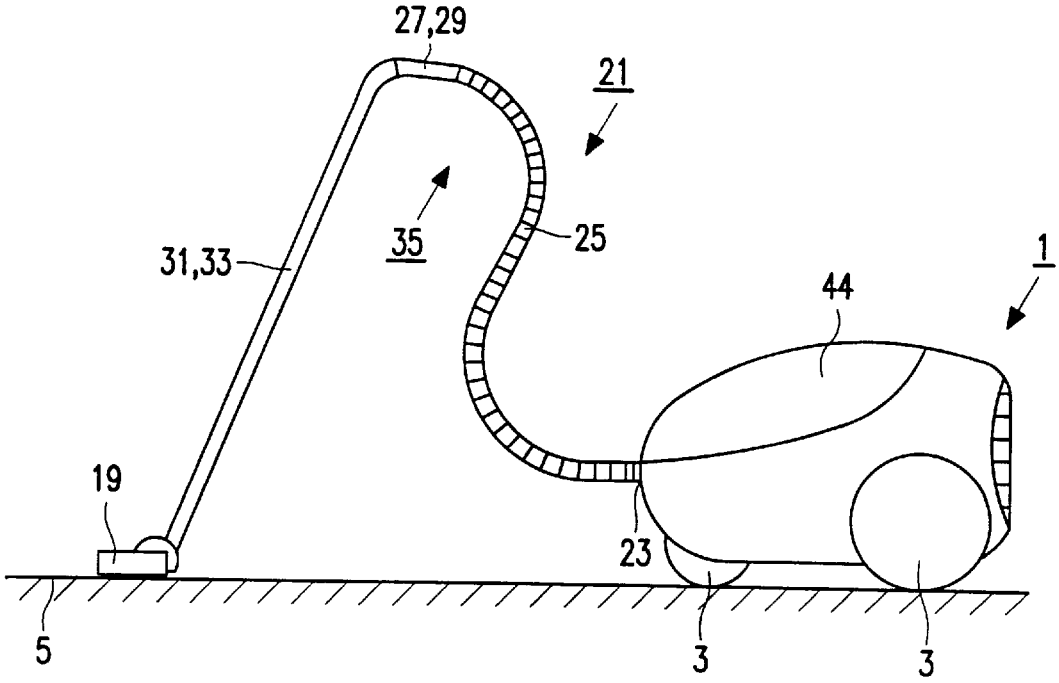
FIG. 1 shows a vacuum cleaner according to the invention.
Figure 2:
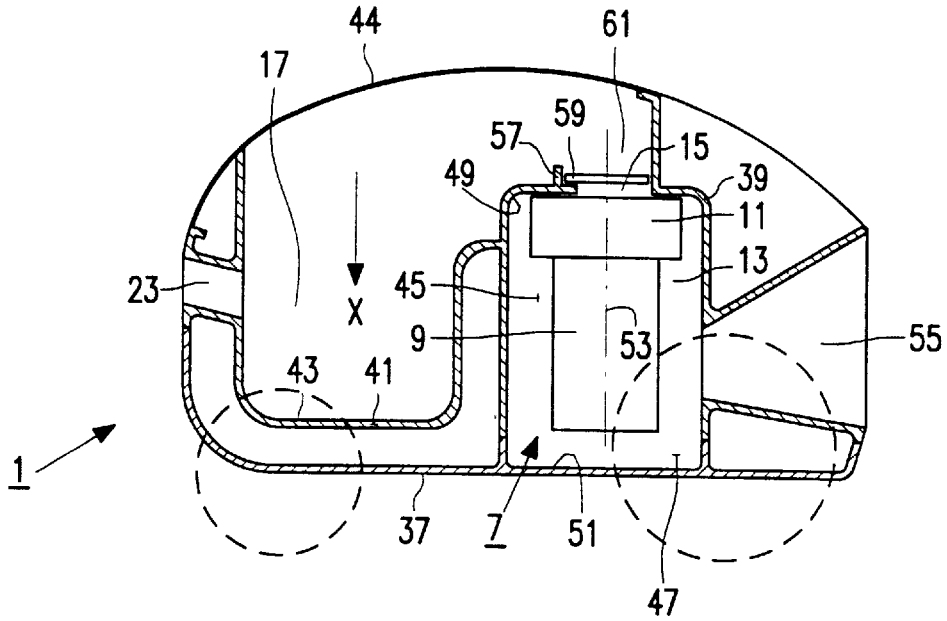
FIG. 2 is a diagrammatic cross-section of a first embodiment of a housing of the vacuum cleaner of FIG. 1.

The vacuum cleaner according to the invention shown in FIG. 1 is a so-called canister-type or horizontal vacuum cleaner comprising a synthetic-resin housing 1 which is provided with a number of wheels 3 by means of which the housing 1 is displaceable, for example, over a surface 5 to be cleaned. As FIG. 2 shows, a suction unit 7 comprising an electric motor 9 and a blade wheel 11 which can be driven by the electric motor 9 is present inside the housing 1. The suction unit 7 is provided in a motor chamber 13 of the housing 1 which is connected to a dust chamber 17 of the housing 1 via a motor inlet 15. As FIG. 1 shows, the vacuum cleaner further comprises a suction mouth 19 which can be coupled to the suction unit 7 via a suction channel 21. The suction channel 21 comprises, in that order, the motor chamber 13, motor inlet 15, and dust chamber 17 of the housing 1 mentioned above, an inlet 23 of the dust chamber 17 shown in FIG. 2, a flexible synthetic-resin hose 25 shown in FIG. 1 which is detachably coupled to the inlet 23, a coupling piece 27 provided with a handle 29, a tubular channel 31 which comprises a hollow metal tube 33, and the suction mouth 19 mentioned above. The flexible hose 25 and the coupling piece 27 together form an auxiliary piece 35 of the vacuum cleaner which is detachably coupled to the tubular channel 31.

As is apparent from the diagrammatic view of FIG. 2, the housing 1 comprises a lower housing part 37 and an upper housing part 39. The upper housing part 39 comprises a depression 41 which faces towards the lower housing part 37 such that the inlet 23 mentioned above issues into the depression 41. The dust chamber 17 is present at a side 43 of the upper housing part 39 facing away from the lower housing part 37, is bounded by the depression 41, and can be closed by means of a lid 44. A dust bag (not shown in the Figures) can be placed in the dust chamber 17 and can be removed therefrom after opening of the lid 44. As FIG. 2 further shows, the motor chamber 13 is enclosed between the lower housing part 37 and the upper housing part 39 such that the motor chamber 13 comprises a chamber 45 of the upper housing part 39 and a chamber 47 of the lower housing part 37. The chamber 45 of the upper housing part 39 is present at a side 49 of the upper housing part 39 facing the lower housing part 37, while the chamber 47 of the lower housing part 37 is present at a side 51 of the lower housing part 37 facing the upper housing part 39. In the position of the vacuum cleaner as shown in FIG. 2, the suction unit 7 is arranged in a vertical direction in the motor chamber 13, the motor shaft axis 53 of the motor 9 extending substantially parallel to the vertical direction, while the blade wheel 11 faces the upper housing part 39. The motor inlet 15 is also provided in the upper housing part 39 and extends substantially perpendicularly to the motor shaft 53. The motor inlet 15 adjoins the blade wheel 11 and is thus present at a side of the suction unit 7 which faces away from the lower housing part 37. An outlet 55 of the motor chamber 13 is furthermore provided in the upper housing part 39. The upper housing part 39 is in addition provided with a holder 57 in which a motor filter 59 can be placed at a side of the motor inlet 15 facing away from the lower housing part 37.

Figure 3:
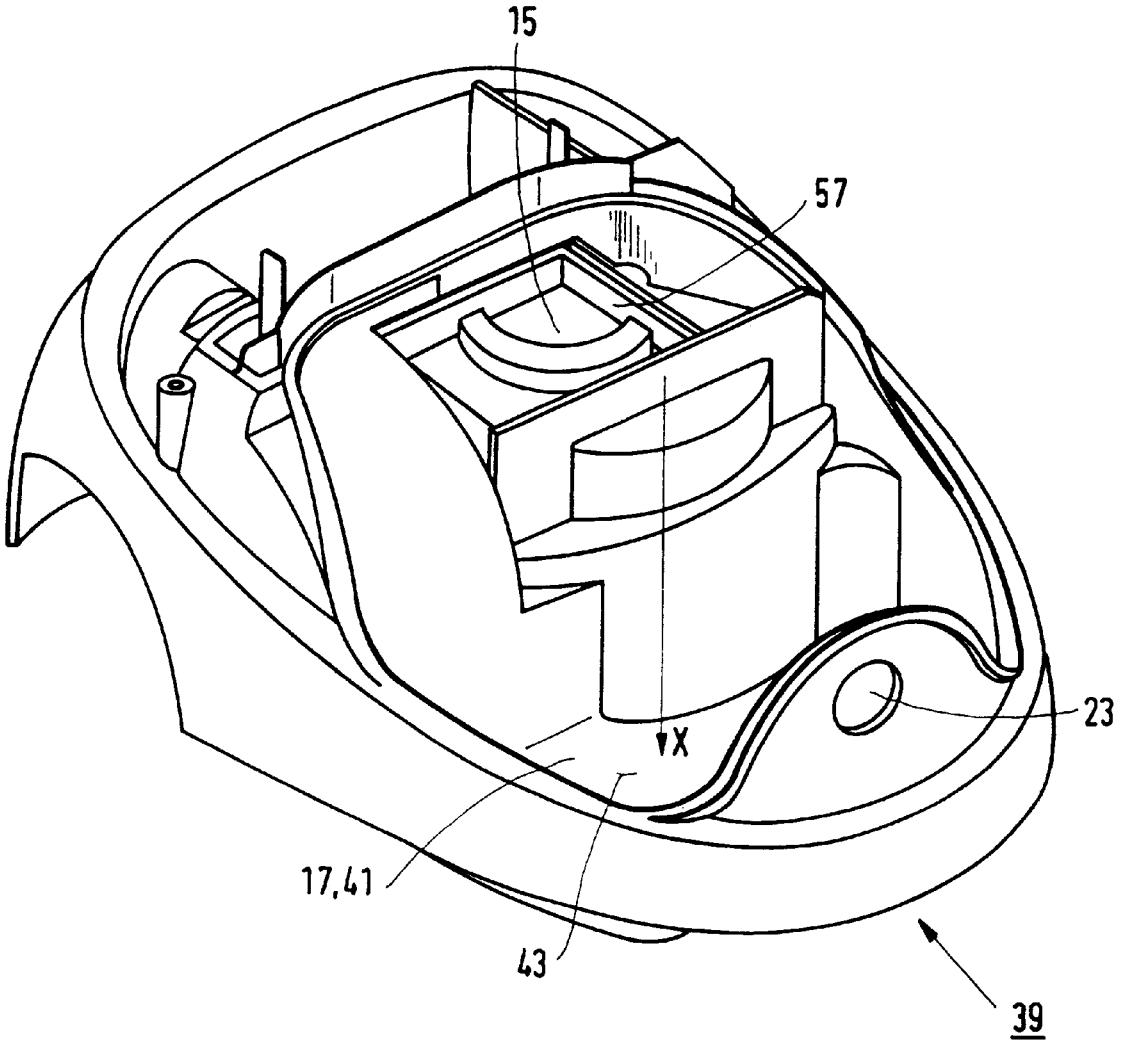
FIG. 3 shows an upper housing part of the housing of FIG. 2.
Figure 4A:
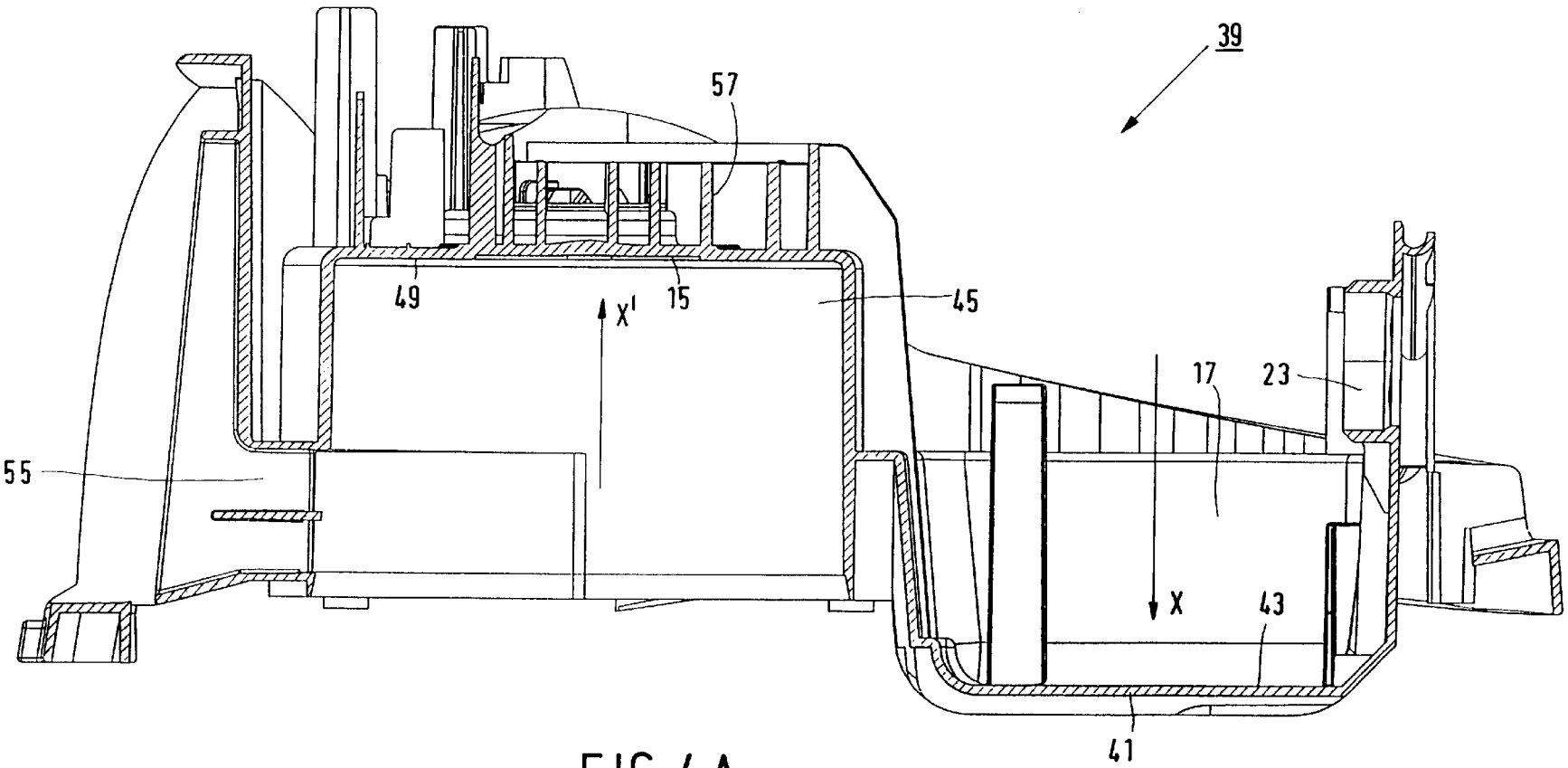
FIG. 4*a* is a cross-section of the upper housing part of FIG. 3.
Figure 4B:
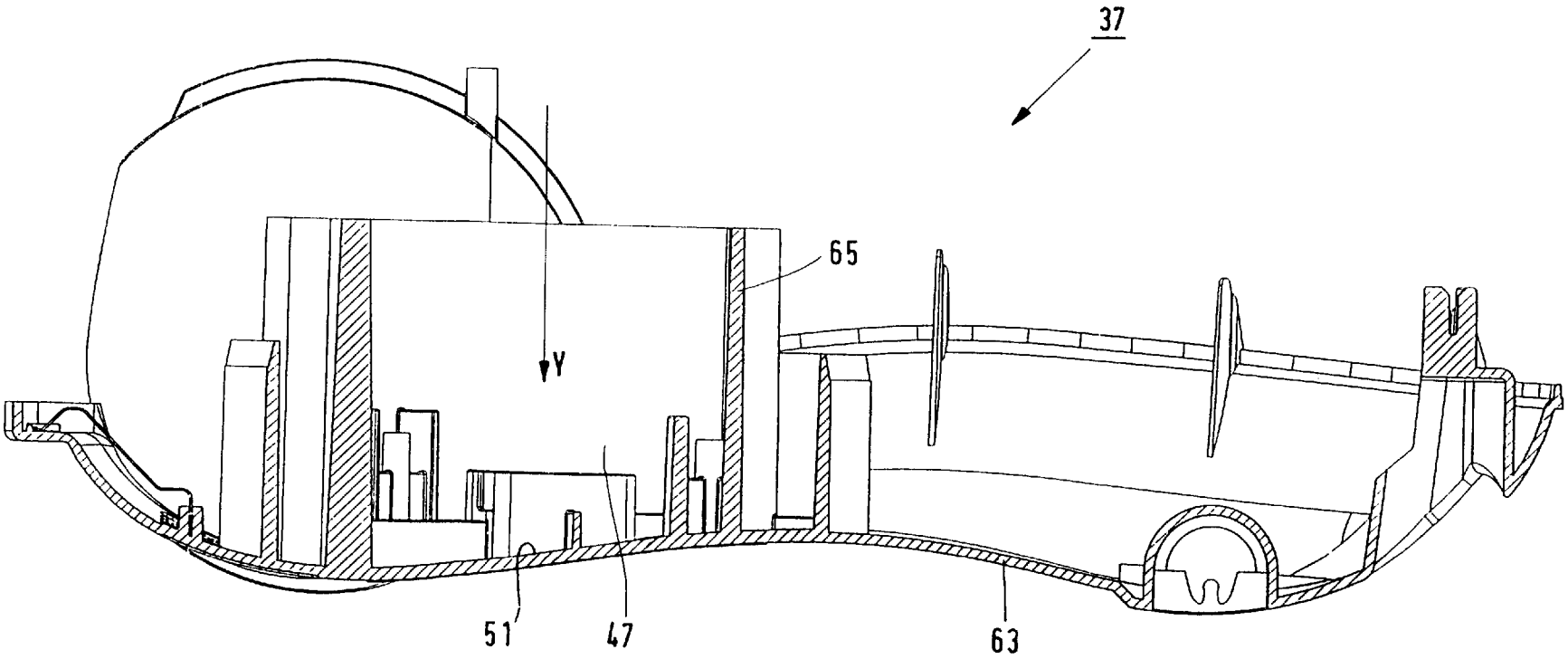
FIG. 4*b* is a cross-section of a lower housing part of the housing of FIG. 2.

The lower housing part 37 and the upper housing part 39 of the housing 1 are manufactured from a synthetic resin in an injection molding process. The upper housing part 39 is shown in FIGS. 3 and 4*a*, and the lower housing part 37 is shown in FIG. 4*b*. A separate mold, comprising two mold halves, is used for the lower housing part 37 and for the upper housing part 39 in said injection molding process. After the injection of the synthetic resin into the relevant mold, one of the mold halves is removed, whereupon the lower housing part 37 or the upper housing part 39 is taken from the other mold half. As FIGS. 3 and 4*a* show, the depression 41 defines a so-called unmoulding direction X of the upper housing part 39. The unmoulding direction X is a direction which is defined with respect to the upper housing part 39 and in which the upper housing part 39 will be removed from the mold after the injection molding process. Since an injection-molded product has only one main unmoulding direction, auxiliary mold pieces such as, for example, so-called mold inserts are often used in injection molding processes. Such a mold insert is inserted into the mold in a direction different from the main unmoulding direction before the injection molding process and is removed from the mold and the injection-molded product after the injection molding process but before the injection-molded product is removed from the mold. Injection-molded products can be provided with portions having an unmoulding direction different from the main unmoulding direction in this manner. According to the invention, the use of such mold inserts is avoided as much as possible in the upper housing part 39. As FIG. 4*a* shows, the chamber 45 of the upper housing part 39 has an unmoulding direction X' which is parallel and opposed to the unmoulding direction X for this purpose. The depression 41 in the upper housing part 39 can thus be formed by means of a mold part integral with one of the two mold halves of the upper housing part 39, while the chamber 45 in the upper housing part 39 can be formed by means of a mold part integral with the other mold half of the upper housing part 39, so that no separate mold inserts are necessary for providing the depression 41 and the chamber 45 in the upper housing part 39. Since the motor inlet 15 extends substantially perpendicularly to the unmoulding direction X' of the chamber 45, i.e. extends in a plane which intersects the unmoulding direction X' of the chamber 45, the motor inlet 15 can also be formed in the upper housing part 39 by means of a mold part integral with one of the mold halves of the upper housing part 39, so that no separate mold insert is necessary for providing the motor inlet 15 either. The fact that the motor inlet 15 is present at the side of the suction unit 7 which faces away from the lower housing part 37, i.e. is provided in an upper wall of the upper housing part 39, implies that the mold part necessary for forming the motor inlet 15 has comparatively small dimensions and a comparatively simple shape. The presence of the motor inlet 15 in said upper wall of the upper housing part 39 in addition simplifies the construction of the upper housing part 39. Since the motor inlet 15 extends substantially perpendicularly to the unmoulding direction X' of the chamber 45, a comparatively small unmoulding force is required for removing the motor inlet 15 from the mold part necessary for forming the motor inlet 15, so that also the force required for unmoulding the upper housing part 39 is reduced. The vertical position of the motor shaft 53 of the suction unit 7, i.e. substantially parallel to the unmoulding direction X of the upper housing part 39, in addition provides a compact construction of the housing 1, with the suction unit 7 placed immediately next to and parallel to the dust chamber 17.

As FIG. 2 shows, the lid 44 of the dust chamber 17 extends over the depression 41 and over the motor inlet 15. An air channel 61 from the dust chamber 17 to the motor chamber 13 is thus bounded by the motor inlet 15, the lid 44, and side walls of the upper housing part 39 extending approximately parallel to the unmoulding direction X. The lid 44 does not form part of the upper housing part 39 but is separately manufactured and fastened to the upper housing part 39. As a result, the air channel 61 in the upper housing part 39 can be formed by means of a mold part which is integral with the mold half with which also the depression 41 is formed, so that again no separate mold insert is required for providing the air channel 61 in the upper housing part 39. Since the lid 44 extends over the motor inlet 15, the holder 57 of the motor filter 59 is directly accessible to a user of the vacuum cleaner after the lid 44 has been opened, which enhances the comfort of use of the vacuum cleaner.

As described above, the dust chamber 17, the motor inlet 15, and the air channel 61 between the dust chamber 17 and the motor chamber 13 are fully integrated with the upper housing part 39 of the housing 1, while the motor chamber 13 is integrated partly with the lower housing part 37 and partly with the upper housing part 39. It is achieved thereby that the lower housing part 37 is of a comparatively simple construction. As FIG. 4*b* shows, the lower housing part 37 as a result mainly comprises a shell 63 and a chamber 65 belonging to the motor chamber 13, defining an unmoulding direction Y of the lower housing part 37. The lower housing part 37 can be manufactured without mold inserts as a result, the mold for the lower housing part 37 having a very simple construction.

Figure 5A:
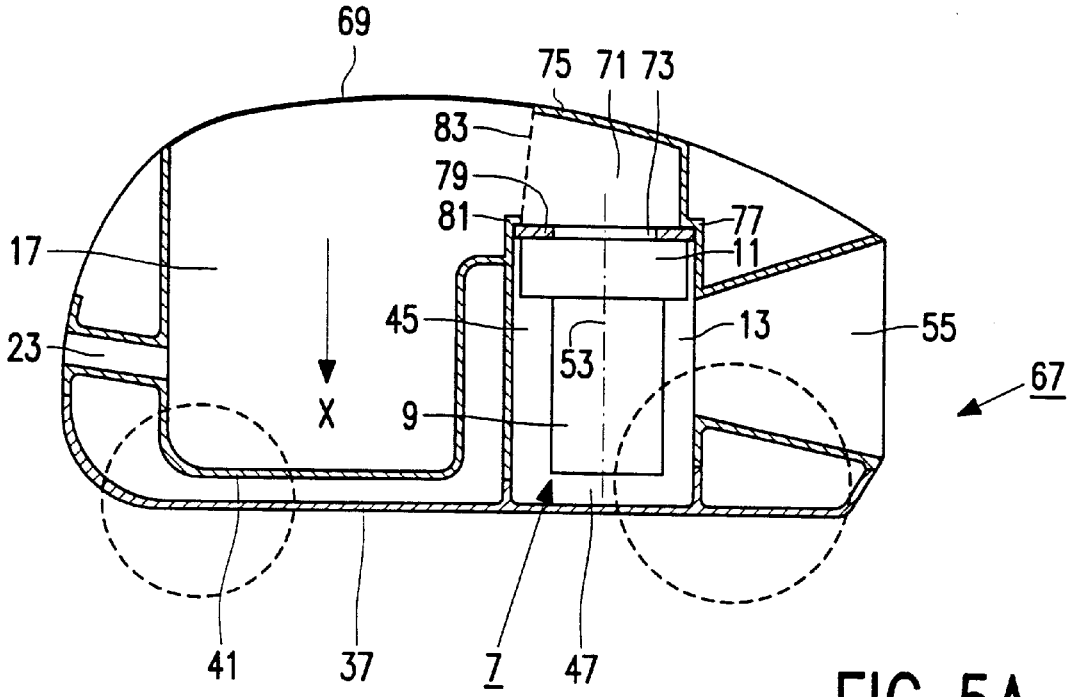
FIG. 5*a* is a diagrammatic cross-section of a second embodiment of a housing of the vacuum cleaner of FIG. 1.

FIG. 5*a* diagrammatically shows a cross-section through a second embodiment of a housing 67 of a vacuum cleaner according to the invention. Components of the housing 67 corresponding to those of the first embodiment of the housing 1 have been given the same reference numerals in the Figures. The description below exclusively relates to a few differences between the housings 1 and 67. As FIG. 5*a* shows, the housing 67 comprises a lid 69 which extends exclusively over the dust chamber 17. The housing 67 further comprises an air channel 71 from the dust chamber 17 to the motor chamber 13 bounded by a motor inlet 73 of the motor chamber 13, a wall 75 of the upper housing part 77 positioned opposite the motor inlet 73, and side walls of the upper housing part 77 extending approximately parallel to the unmoulding direction X. The motor inlet 73 in the housing 67 is provided in a synthetic-resin plate 79 which is fastened to a flange 81 integral with the upper housing part 77 after the upper housing part 77 has been manufactured. The dust chamber 17 of the upper housing part 77 of the housing 67 is formed, as is the dust chamber 17 of the upper housing part 39 of the housing 1, by means of a mold part integral with one of the two mold halves of the upper housing part 77 during the injection molding process, while the chamber 45 is formed in the upper housing part 77 of the housing 67 by means of a mold part integral with the other mold half of the upper housing part 77. Since the plate 79 with the motor inlet 73 is not fastened in the upper housing part 77 until after this upper housing part 77 has been manufactured, the air channel 71 can also be formed by means of the mold part with which the chamber 45 is formed in the injection molding process. The mold part with which the dust chamber 17 is formed and the mold part with which the chamber 45 and the air channel 71 are formed bear on one another during the injection molding process along a so-called separation surface 83 which is indicated with a broken line in FIG. 5*a* and which intersects the unmoulding direction X at a comparatively small angle. The result of this is that the dust chamber 17, the chamber 45, and the air channel 71 of the upper housing part 77 of the housing 67 can be formed, as can the dust chamber 17, the chamber 45, and the air channel 61 of the upper housing part 39 of the housing 1, without the use of mold inserts.

Figure 5B:
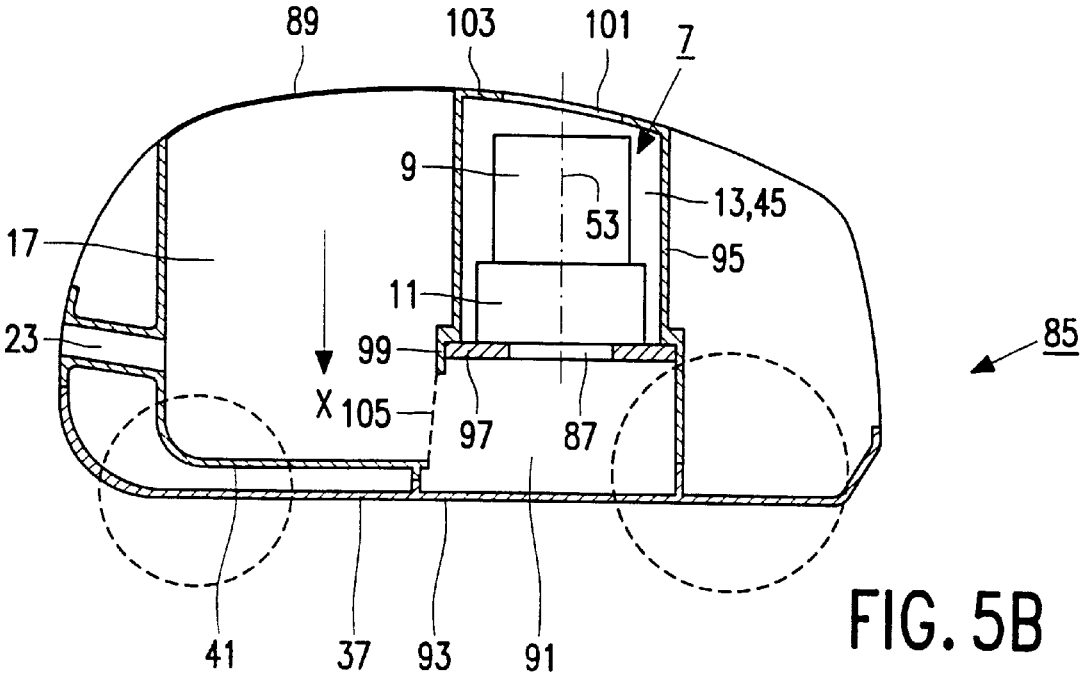
FIG. 5*b* is a diagrammatic cross-section of a third embodiment of a housing of the vacuum cleaner of FIG. 1.

FIG. 5*b* is a diagrammatic cross-section of a third embodiment of a housing 85 of a vacuum cleaner according to the invention. Components of the housing 85 corresponding to those of the first embodiment of the housing 1 have been given the same reference numerals in the Figures. The following description only relates to a few differences between the housings 1 and 85. As FIG. 5*b* shows, the motor chamber 13 of the housing 85 comprises a motor inlet 87 which is present at a side of the suction unit 7 which faces the lower housing part 37, while the blade wheel 11 of the suction unit 7 immediately adjoins the motor inlet 87. The housing 85 comprises, as does the housing 67, a lid 89 which extends exclusively over the dust chamber 17. The housing 85 further comprises an air channel 91 from the dust chamber 17 to the motor chamber 13 which is bounded by the motor inlet 87, a wall 93 of the lower housing part 37 positioned opposite the motor inlet 87, and side walls of the upper housing part 95 which extend approximately parallel to the unmoulding direction X. The motor inlet 87 is provided in a synthetic-resin plate 97 in the housing 85, as was indeed the case in the housing 67, which plate is fastened to a flange 99 integral with the upper housing part 95 after the manufacture of this upper housing part 95. The dust chamber 17 of the upper housing part 95 of the housing 85 is formed, as is the dust chamber 17 of the upper housing part 39 of the housing 1, by means of a mold part integral with one of the two mold halves of the upper housing part 95 during the injection molding process. Since the plate 97 with the motor inlet 87 is not fastened in the upper housing part 95 until after this upper housing part 95 has been manufactured, the chamber 45 in the upper housing part 95 of the housing 85 can be formed by means of a mold part integral with the other mold half of the upper housing part 95. Furthermore, a motor outlet 101 is also formed in an upper wall 103 of the upper housing part 95 by means of the same mold part with which the chamber 45 is formed. The mold part with which the chamber 45 and the motor outlet 101 are formed also serves to form the air channel 91, the latter mold part and the mold part with which the dust chamber 17 is formed bearing on one another during the injection molding process along a separation surface 105 which is indicated with a broken line in FIG. 5*b* and which intersects the unmoulding direction X at a comparatively small angle. The dust chamber 17, the chamber 45, the air channel 91, and the motor outlet 101 of the upper housing part 95 can thus be formed without the use of mold inserts.

The vacuum cleaner described above is a canister-type vacuum cleaner in which the suction mouth 19 is connected via the flexible hose 25 to the displaceable housing 1 in which the dust chamber 17 and the suction unit 7 are present. It is noted that the invention is equally applicable to alternative types of vacuum cleaners such as, for example, upright vacuum cleaners provided with a suction mouth which is hinged to an upright housing in which a dust chamber and a suction unit are arranged.

In the embodiments of a housing 1, 67, 85 according to the invention as described above, the motor inlet 15, 73, 87 extends perpendicularly to the unmoulding direction X of the upper housing part 39, 77, 95. It is noted that the motor inlet may alternatively extend transversely or obliquely to the unmoulding direction of the upper housing part according to the invention. In general, the invention also covers embodiments in which the motor inlet extends in a plane which intersects the unmoulding direction, i.e. in a plane which is not parallel to the unmoulding direction.

The unmoulding directions X and X' extend in vertical direction, with the vacuum cleaner occupying a position as shown in FIG. 1, in the embodiments of a housing 1, 67, 85 according to the invention described above. It is finally noted that, according to the invention, the parallel unmoulding directions X and X' may also extend in an alternative direction, for example a direction enclosing an acute angle with the vertical direction, with the vacuum cleaner occupying the position as shown in FIG. 1.

What is claimed is:

1. A vacuum cleaner comprising:

a housing which is provided with a dust chamber and a motor chamber containing a suction unit, said dust chamber being connected to said motor chamber via a motor inlet;

the housing consisting essentially of a lower housing part and an upper housing part;

the dust chamber being present at a side of the upper housing part facing away from the lower housing part and is bounded by a depression of the upper housing part which faces towards the lower housing part and which defines an unmolding direction of the upper housing part;

the motor chamber comprising a chamber of the upper housing part which is present at a side of the upper housing part facing towards the lower housing part and has an unmolding direction which is parallel to the unmolding direction of the upper housing part;

the motor inlet being provided in the upper housing part and extending in a plane which intersects the unmolding direction.

2. A vacuum cleaner as claimed in claim 1, wherein the motor inlet is present at a side of the suction unit which faces away from the lower housing part.

3. A vacuum cleaner as claimed in claim 2, wherein the motor inlet extends substantially perpendicularly to the unmolding direction.

4. A vacuum cleaner as claimed in claim 2, wherein the dust chamber is closable by means of a lid which extends over the depression and over the motor inlet.

5. A vacuum cleaner as claimed in claim 2, wherein a motor filter is placeable at a side of the motor inlet which faces away from the lower housing part.

6. A vacuum cleaner as claimed in claim 1, wherein the suction unit comprises a motor shaft which is directed substantially parallel to the unmolding direction.

* * * * *